United States Patent [19]

Little

[11] 4,063,388

[45] Dec. 20, 1977

[54] SLIDING DOOR

[75] Inventor: Benjamin F. Little, Oklahoma City, Okla.

[73] Assignee: Roto-Swing, Inc., Oklahoma City, Okla.

[21] Appl. No.: 741,157

[22] Filed: Nov. 11, 1976

[51] Int. Cl.[2] ..... E05F 11/12

[52] U.S. Cl. ..... 49/363; 49/141

[58] Field of Search ..... 49/323, 363, 141, 118, 49/119, 122

[56] References Cited

U.S. PATENT DOCUMENTS

| | | | |
|---|---|---|---|
| 3,453,778 | 7/1969 | Daugirdas | 49/363 X |
| 3,834,081 | 9/1974 | Catlett | 49/118 X |

*Primary Examiner*—Kenneth Downey

*Attorney, Agent, or Firm*—William S. Dorman

[57] ABSTRACT

A sliding door for a doorway comprising a door frame, an upper horizontal housing extending across the top of the door frame, a rear stationary panel mounted within the door frame to one side of a door opening in the door frame, and means for mounting the sliding door for horizontal sliding movement from a closed position over the door opening to an open position in front of the stationary panel. A vertical side of the sliding door abuts over a vertical side of the stationary panel, and a vertical track is mounted on the vertical side of the sliding door between the sliding door and the stationary panel. A vertical pivot arm is pivotally mounted adjacent its upper end in the upper housing in substantial alignment with the vertical side of the sliding door when the sliding door is in its closed position. A guide roller is mounted on the lower end of the vertical arm and received within the vertical track. Means are provided in the upper housing for pivoting the vertical arm to move the sliding door horizontally from its closed position over the door opening to its open position in front of the stationary panel.

4 Claims, 6 Drawing Figures

SLIDING DOOR

BACKGROUND OF THE INVENTION

1. Field of the Invention

The present invention relates to a sliding door and, more particularly, to a sliding door whose movement is effected by a pivotal arm.

2. Description of the Prior Art

There are many different types of automatic doors in use today on commercial buildings where the door is opened in response to the approach of a customer. Some of these doors pivot inwardly or outwardly about a vertical pivot axis; some doors slide horizontally; and some doors open with a combined sliding and pivoting movement. These doors can be single doors or double doors.

SUMMARY OF THE INVENTION

The present invention involves an improvement in sliding doors wherein the sliding door is caused to move horizontally by means of a vertical pivot arm which pivots about its upper end above the door. The sliding door is mounted in a doorway which includes an upper horizontal housing extending across the top of the door frame. A rear stationary panel is also mounted within the door frame to one side of the door opening. Means are provided in the upper horizontal housing for permitting horizontal sliding movement of the door from a closed position over the door opening to an open position in front of the stationary panel. A vertical side of the sliding door abuts over a vertical side of the stationary panel. A vertical track is mounted on the vertical side of the sliding door between the sliding door and the stationary panel. The vertical pivot arm whose upper end is pivotally mounted in the upper housing is in substantial alignment with the vertical side of the sliding door when the sliding door is in its closed position. A guide roller is mounted at the lower end of the vertical arm and is received within the vertical track. Means are provided within the upper housing for pivoting the arm to move the sliding door slidably from its closed position over the door opening to its open position in front of the stationary panel. In one embodiment of the invention, the sliding door is a single sliding door. In another embodiment of the invention, two sliding doors are provided, and these doors move away from each other and towards each other to open and close the door opening.

DETAILED DESCRIPTION OF THE PREFERRED EMBODIMENTS

Figure 1:
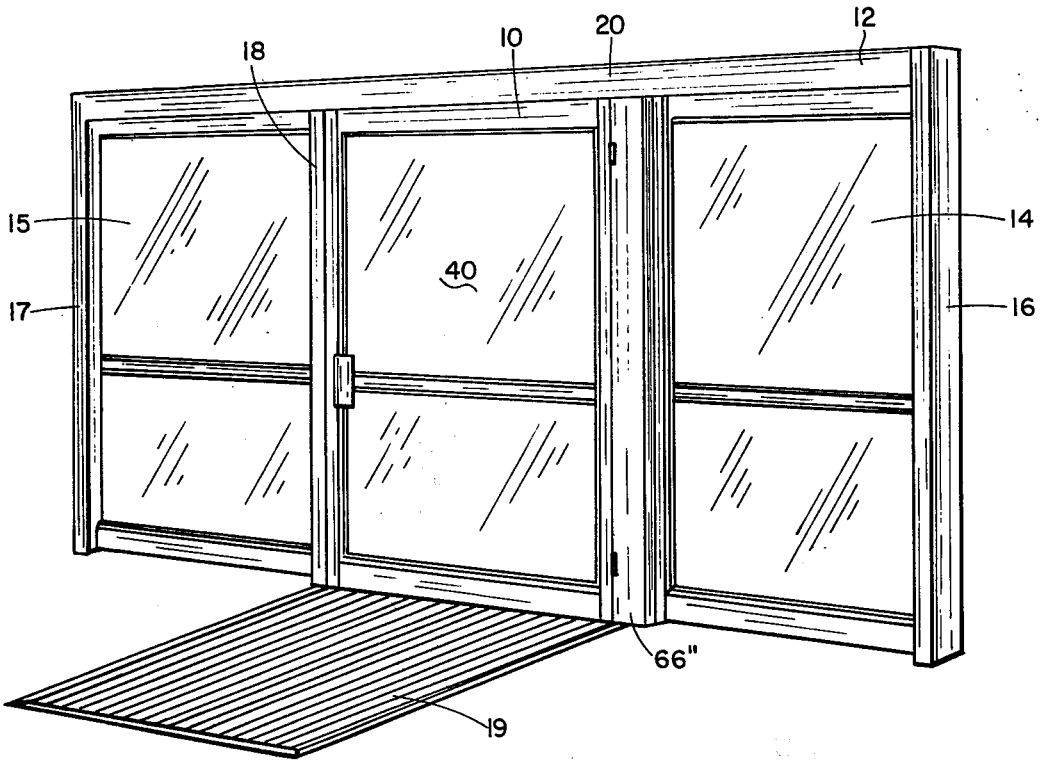
FIG. 1 is a perspective view, in simplified pictorial form, of one embodiment of the invention showing a single sliding door.

Referring to the drawings in detail, FIG. 1 shows a sliding door 10 mounted within a framework 12 which includes stationary rear panels 14 and 15, vertical frame members 16, 17 and 18 and an upper horizontal housing 20 in which the controls (later to be described) are mounted. The door opening, now closed, is the space occupied by the door to the right of frame member 18. As will be hereinafter, the door 10 is adapted to slide towards the right in front of the stationary panel 14. A door mat 19 can be provided for the purpose of actuating the controls for the door in a conventional manner when a person steps on the mat.

Figure 2:
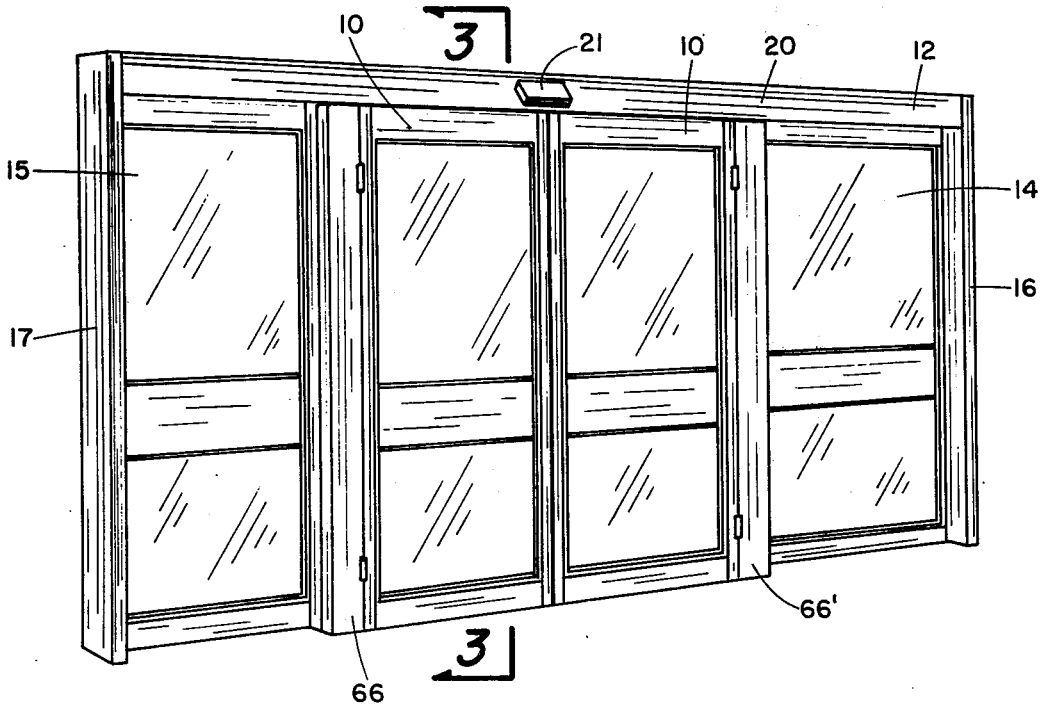
FIG. 2 is a view similar to FIG. 1, from an opposite perspective, of another embodiment of the invention showing double sliding doors.

In FIG. 2, two doors 10, 10 are mounted within the framework 12 over the door opening, now closed. The right hand door 10 slides in front of the rear panel 14 as in the case of FIG. 1. However, the left door 10 slides in front of the rear panel 15 towards the side member 17 (the side member 18 being omitted from FIG. 2). Controls for operating the doors simultaneously will be mounted in the upper horizontal housing 20. If desired, a presence-sensing detector 21, can be provided to open the doors 10, or a mat can be used as in the case of FIG. 1.

In both instances, FIG. 1 or 2, the framework 12 will be suitably mounted and in a conventional manner in a convenient opening in a storefront or building (not shown).

Figure 3:
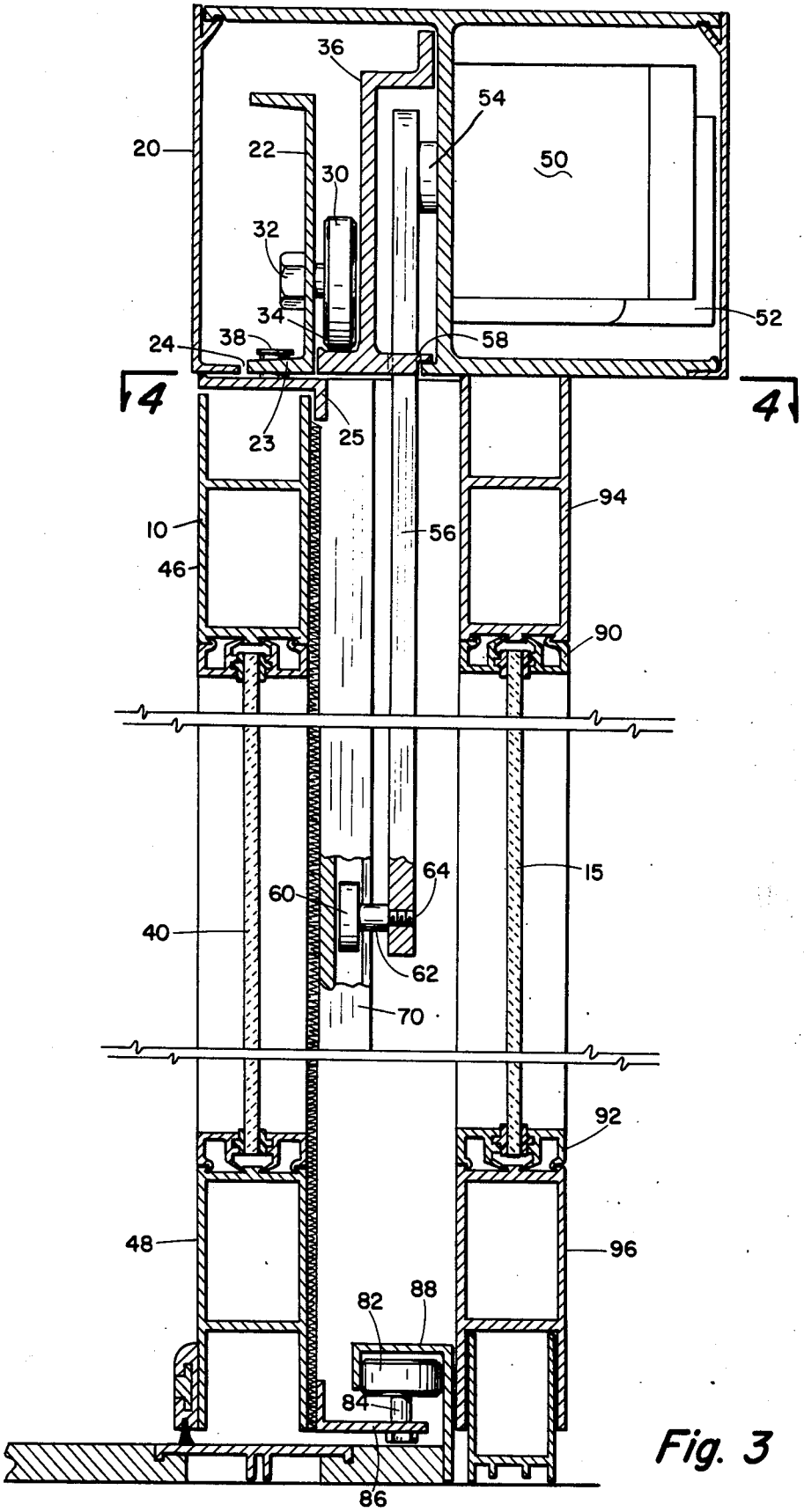
FIG. 3 is a vertical sectional view, on an enlarged scale, taken along section line 3—3 of FIG. 2.

Referring now to FIG. 3, a longitudinal slot 24 is provided along the lower surface of the housing 20. A horizontally extending channel member 22 is mounted within the housing 20 such that the lower portion 23 of this channel member extends into the slot 24. A pair of spaced rollers 30 (only one which is shown) are connected adjacent the ends of the channel member 22 by means of bolts 32. The rollers 30 ride in a horizontal track 34 in a supporting member 36 which is secured within the housing 20. The lower portion 23 of the channel 22 is connected to the upper edge 25 of the door 10 by means of a pair of spaced bolts or rivets 38 (only one of which is shown). The channel member 22 extends substantially across the entire width of the door and permits sliding movement thereof from the closed position shown in FIG. 4 to the open position shown in FIG. 5.

The door 10 can be solid, if desired, but preferably has a center glass plate 40 which is fitted between vertical rails 42 and 44 and the upper horizontal rail 46 and the lower horizontal rail 48 of the door.

A motor 50 is mounted within the housing 20. The motor is connected to a gearing system 52 which includes variable speed controls (not shown) and which also includes a horizontal output shaft 54 which connects with the upper end of a pivotal arm 56. The pivotal arm is free to pivot in a vertical plane by virtue of the horizontal slot 58 provided in the supporting member 36. The lower end of the pivotal arm 56 is provided with a roller 60 mounted on a stub shaft 62 whose reduced threaded end 64 is screwed into a threaded opening at the lower end of the arm 56.

Figure 4:
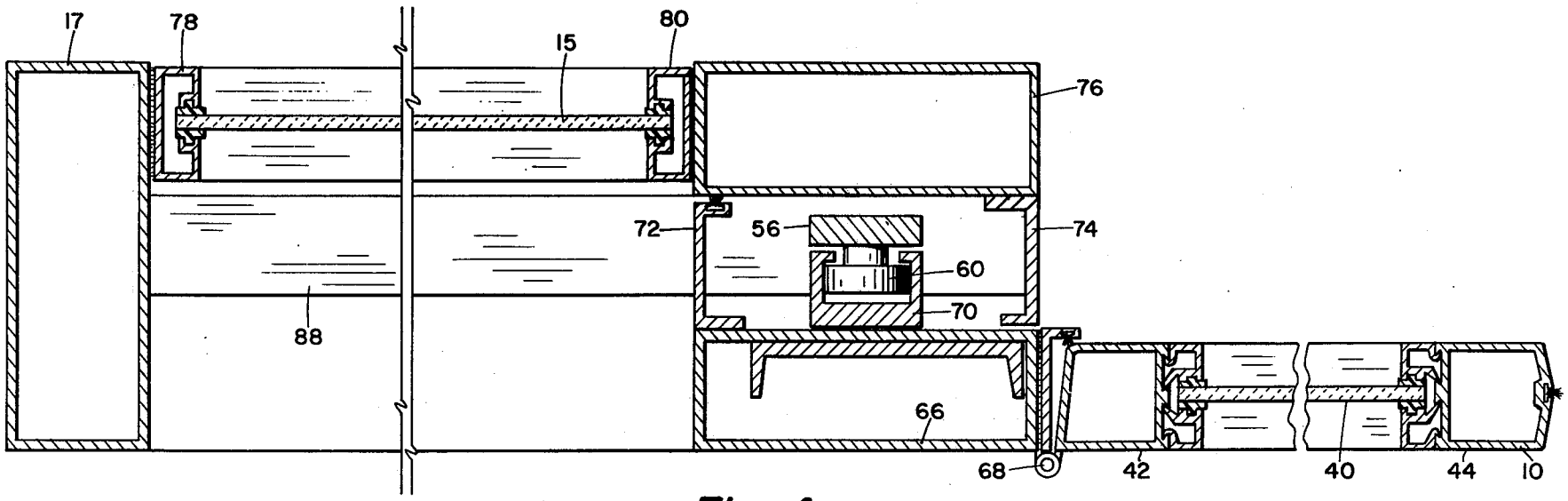
FIG. 4 is a horizontal sectional view taken along section line 4—4 of FIG. 3 showing the sliding door in its closed position.
Figure 5:
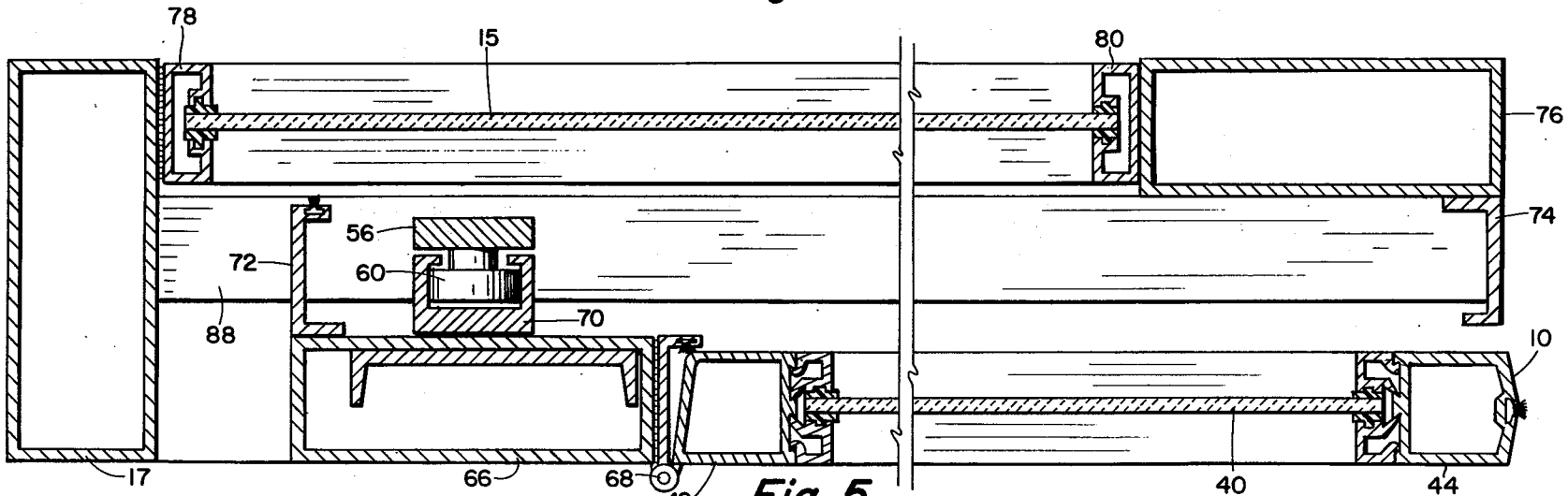
FIG. 5 is a horizontal sectional view similar to FIG. 4 but showing the sliding door in its open position.

The vertical portion 42 of the door 10 is connected with a vertical frame member 66 through break-away hinge members 68 (only one of which is shown in FIGS. 4 and 5). Normally, the break-away door leaf consisting of the vertical rails 42 and 44, the horizontal rails 46 and 48 and the glass 40 is held in position shown in FIGS. 4 and 5 with respect to the vertical frame member 66. However, in the event of a power failure, the break-away door leaf can be forced to pivot clockwise around the break-away hinges 68. The break-away door panel, as described above, also pivots with relation to the upper edge 25 of the door. A manual door closer (not shown) would be located in the upper horizontal rail 46 to return the break-away leaf to the positions shown in FIGS. 4 and 5.

The roller 60 located at the bottom of the pivotal arm 56 rides in a vertical track formed by the channel member 70 which is attached to the rear of the vertical frame member 66. In the closed position of the door, as shown in FIG. 4, the vertical track 70, pivotal arm 56 and roller 60 are enclosed within a vertical housing formed by the vertical strip 72 attached to the vertical frame member 66 and the vertical strip 74 attached to rear vertical frame member 76. When the door is moved in the open position, as shown in FIG. 5, the vertical strip 72 is carried to the left by the frame member 66 whereas the vertical strip 74 remains attached to the vertical frame member 76. The rear stationary panel 15 is secured between vertical window rails 78 and 80 which are attached to the frame elements 17 and 76, respectively.

If the arm 56 is pivoted about the shaft 54, so as to urge the lower end of the arm 56 to the left, (with respect to FIG. 4) the roller 60 will urge the track 70 and hence the door 10 to the left until it reaches the position shown in FIG. 5. At the same time, the roller 60 will be riding upwardly in the track 70, the travel path of the roller 60 being a circular arc, as shown diagrammatically in FIG. 6.

In order to provide further stability for the door 10, another roller 82 (see now FIG. 3) is mounted on a vertical shaft 84 which is connected to an L-shaped member 86 which, in turn, is connected to the lower door rail 48 below the channel member 70. A bottom guide 88, somewhat channel shaped, is connected to and extends from the right hand end of the frame member 76 across the front of the rear panel 15 to the frame member 17 and provides a track for the roller 82.

Figure 6:
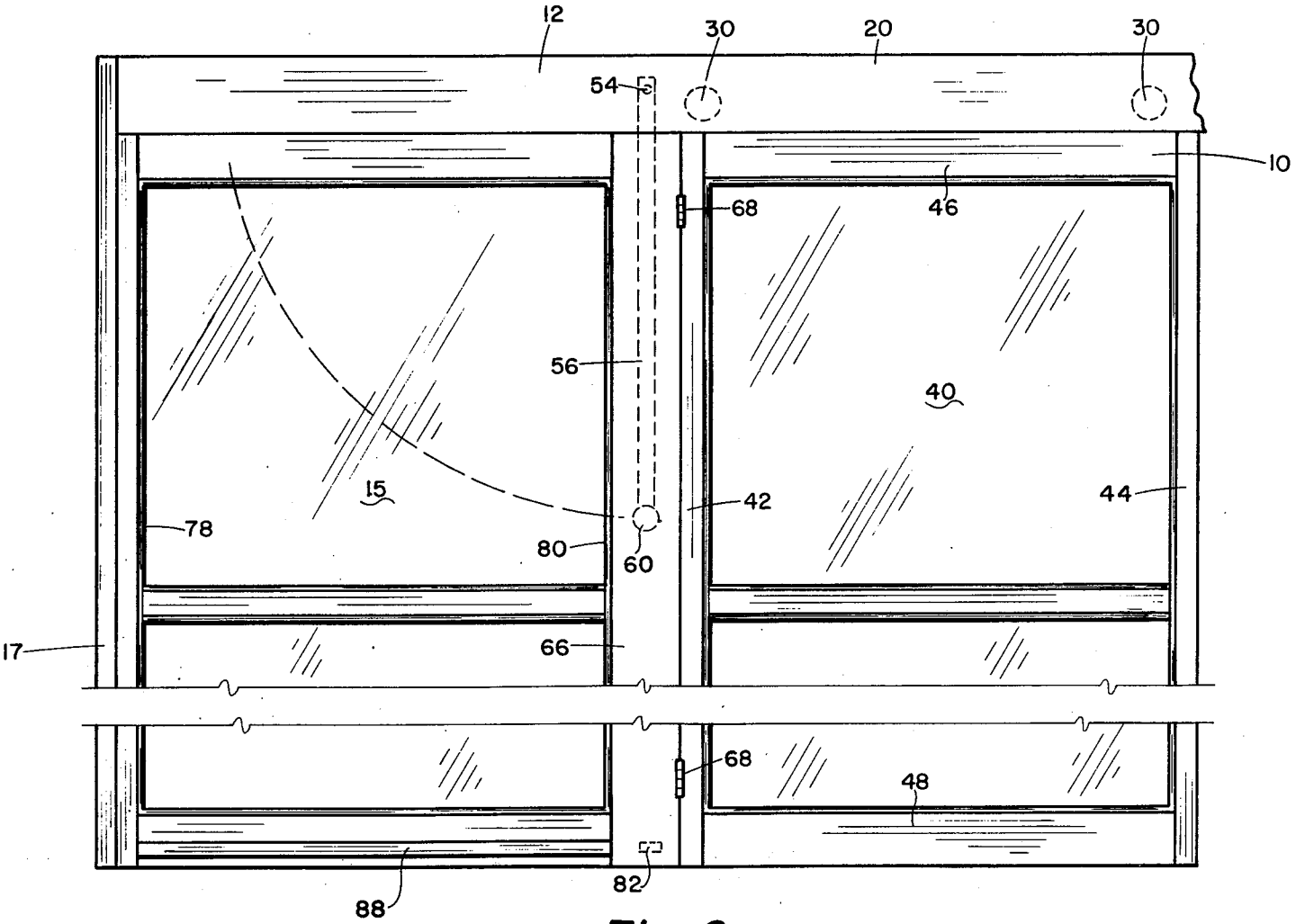
FIG. 6 is a semi-diagrammatic front view of the left hand portion of FIG. 2 showing the relative positions of the pivot arm and the various rollers in relation to the door and associated structure.

As also shown in FIG. 3, the rear stationary panel 15 is connected to upper and lower window rails 90 and 92, respectively, which, in turn, are connected to horizontal frame members 94 and 96, respectively. The horizontal frame member 94 is connected to the rear portion of the upper housing 20, whereas the lower horizontal frame member 96 rests on the floor of the building in which the doorway is mounted. FIG. 6 shows, in dotted lines, the relative positions of the rollers 30, the roller 82, the roller 60 and the pivotal arm 56 with respect to the door 10 and associated structure.

Whereas, the description of FIGS. 4, 5 and 6 has been made in particular relation to the left hand door 10 shown in FIG. 2, it should be understood that a pivot arm (not shown) identical to pivot arm 56 will be located in the housing 20 for moving the right hand door 10 in identical fashion. In the closed position shown in FIG. 2, this second pivotal arm will be in alignment with the frame portion 66′ for the right hand door 10 and will engage a track (not shown) substantially identical to track 70 which will be secured to the rear of the frame portion 66′ in the same manner as described above in relation to the left hand door 10. In like manner, a pivotal arm (not shown) substantially identical to pivot arm 56 will extend downwardly from the frame member 20 shown in FIG. 1 and the lower end of this pivotal arm (not shown) will carry a roller (not shown) identical to roller 60 which will engage a track (not shown) substantially identical to track 70 which will be mounted on the rear of the frame member 66″ for the door 10 shown in FIG. 1.

In operation, the door of FIG. 1 will slide to the right in response to the counterclockwise pivotal movement of the pivotal arm (not shown). This arm will, at all times, be disposed between the movable door 10 and the stationary panel 14 so as to be inaccessible. The left hand and right hand doors 10 in FIG. 2 will slide to the left and right, respectively, and their respective pivotal arms, at all times, will be disposed between the doors 10 and the stationary panels 14 and 15, respectively. A child, for example, would be unable to reach the pivotal arm 56 in either the open or closed position of the door 10.

What is claimed is:

1. A sliding door for a doorway comprising a door frame, an upper horizontal housing extending across the top of the door frame, a rear stationary panel mounted within the door frame to one side of a door opening in the door frame, means for mounting said sliding door for horizontal sliding movement from a closed position over said door opening to an open position in front of said stationary panel, a vertical side of said sliding door abutting over a vertical side of said stationary panel, a vertical track on said vertical side of said sliding door between said sliding door and said stationary panel, a vertical pivot arm pivotally mounted adjacent its upper end in said upper housing and in substantial alignment with said vertical side of said sliding door when said sliding door is in its closed position, a guide roller at the lower end of said vertical arm and received within said vertical track, and means mounted within said upper housing for pivoting said vertical arm to move said sliding door slidably from its closed position over said door opening to its open position in front of said stationary panel.

2. A sliding door as set forth in claim 1 wherein said means for mounting said sliding door for horizontal sliding movement includes a horizontal track mounted within said upper housing and a pair of spaced support rollers connected to the upper end of said sliding door and engagable with said horizontal track.

3. A sliding door as set forth in claim 2 including a lower roller connected to the lower end of said vertical side of said sliding door and a horizontal track connected along the lower portion of said stationary panel for receiving said lower roller therein.

4. A sliding door as set forth in claim 1 wherein said sliding door is connected to said vertical side of said sliding door through a vertical hinge means to permit manual swinging movement of said door in the event of a power failure.

* * * * *